United States Patent [19]

Mochida

[11] 3,961,731

[45] June 8, 1976

[54] DRIPPING VESSEL

[75] Inventor: Ei Mochida, Tokyo, Japan

[73] Assignee: Mochida Seiyaku Kabushiki Kaisha, Tokyo, Japan

[22] Filed: Apr. 28, 1975

[21] Appl. No.: 572,507

[30] Foreign Application Priority Data

May 2, 1974 Japan ..... 49-050358[U]

[52] U.S. Cl. ..... 222/390; 222/562; 239/331

[51] Int. Cl.[2] ..... B67D 5/42; B65D 47/04

[58] Field of Search ..... 239/329, 331, 145; 222/390, 562

[56] References Cited

UNITED STATES PATENTS

| | | | |
|---|---|---|---|
| 1,965,271 | 7/1934 | Wharton | 222/390 X |
| 2,199,877 | 5/1940 | Cervera | 222/390 X |
| 2,946,486 | 7/1960 | Gilmont | 222/390 X |
| 3,117,696 | 1/1964 | Herman et al. | 222/390 X |
| 3,212,685 | 10/1965 | Swan et al. | 222/390 X |
| 3,281,023 | 10/1966 | Bruck et al. | 222/390 |
| 3,349,975 | 10/1967 | Damron | 222/562 X |
| 3,353,718 | 11/1967 | McLay | 222/390 X |

*Primary Examiner*—Robert S. Ward, Jr.
*Attorney, Agent, or Firm*—Brisebois & Kruger

[57] ABSTRACT

A dripping vessel according to the present invention is characterized in that one end of a metal or glass cylinder is closed except for a fine tube projecting therethrough, while the other end of the cylinder is open with a movable plug of fluoro rubber or fluoro resin provided therein. This movable plug can be moved back and forth within said cylinder by the rotation of a screw threaded into said other end of said cylinder or into one end of a casing which holds said cylinder, whereby a desired amount of hardening agent which fills said cylinder can be forced out by the movement of said movable plug.

5 Claims, 3 Drawing Figures

DRIPPING VESSEL

BACKGROUND OF THE INVENTION

It is well known from the Japanese Publication No. Sho 42-12318 that a bonding and filling material which uses alkyl boron as a hardening agent in acryl resin, has a strong bonding strength to bone or teeth and is useful for dental and surgical use. Alkyl boron which is used as the hardening agent, however, is a highly unstable substance which is liable to ignite by easily reacting with oxygen in the air and liable to lose its activity as the hardening agent by hygroscopicity. To remove this drawback, various methods have been proposed, but with no satisfactory results.

As stated above, alkyl boron is so unstable to oxygen in the air that it is usually stored in a sealed ampule. This method of storage, however, though it is perfect, has the drawback that the ampule must be sealed again after every use; and every time it is unsealed, the air is admitted and thereby the activity of the hardening agent contained therein drops, with the result that it is not possible to obtain a polymer of constant physical properties each time. Meanwhile, since alkyl boron is a colorless liquid of low viscosity, there is a hazard of the liquid flowing out and getting ignited when the vessel with an imperfect seal happens to fall.

A bonding and filling material which uses alkyl boron as a hardening agent, is thus so excellent in performance that removal of the above drawback by some method has been strongly demanded from dentists and surgeons.

Brief Summary of the Invention

The object of the present invention is to provide a dripping vessel easy to handle which can dispense a necessary amount of alkyl boron with safety.

BRIEF DESCRIPTION OF DRAWINGS

In FIGS. 1 and 2, 1 is a cylinder, 2 is a movable plug, 4 is a front plug, 4' is a closed end, 5 is a hardening agent for use in filling teeth, 6 is a screw, and 8 is a fine tube,

DETAILED EXPLANATION OF THE INVENTION

Figure 1:
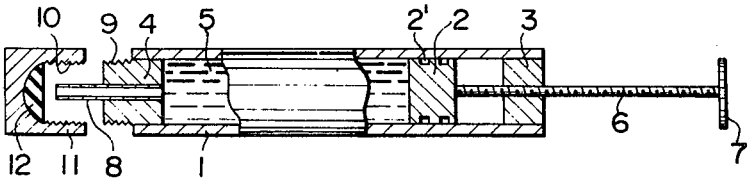
FIG. 1 is a fragmentary side view of one embodiment of a dripping vessel according to the present invention.

Referring to the drawings, the present invention is to be described.

FIG. 1 is a fragmentary side view showing one embodiment of the present invention, 1 being the cylinder, 2 the movable plug, 3 the rear plug with a central screw hole, 4 the front plug with the fine dripping tube 8 at the center, 5 the hardener, 6 the screw threaded rod and 7 the knob. In using the vessel according to the present invention, the screw threaded rod 6 is rotated by the knob 7; thereby the movable plug 2 is moved forward and as the result the necessary amount of hardening agent 5 within the cylinder 1 can drip out through the tube 8. After use, the front plug 4 is covered with a cap 11 which is internally coated with fluoro rubber 12, so that the air can be prevented from getting in through the tip of the tube 8. The cap 11 may be fastened with the internal threads 10 and the threads 9 provided around the tip of the front plug 4; or it may be fastened by a tongue and groove. The cap 11 should, however, be so arranged that the fluoro-rubber 12 and the tip of the fine tube 8 may come into contact.

Such being the constitution of the present invention, the necessary amount of alkyl boron as hardening agent can be taken out and after that the tip of the fine tube 8 has only to be plugged with fluoro-rubber for the purpose of shutting off the air. Therefore, the dripping vessel according to the present invention is easy to handle and the deterioration of the hardening agent can be prevented.

The feature of the present invention, in view of the fact that as stated above alkyl boron as hardening agent is corrosive to many organic materials, reacts violently with oxygen in the air, thereby deteriorating in activity or leading to ignition, lies in that a glass or metal cylinder is used and especially in that the movable plug is made of fluoro resin or fluoro rubber.

After various investigations about the movable plug to serve as a sealing means, the present inventor learned that a common organic material is attacked by alkyl boron; even a synthetic resin like polyethylene which is resistant to such attack cannot perfectly be free from the influence of oxygen and water in the air with the result which deteriorates trialkyl boron; it lacks slidability when used as the movable plug; and the movable plug made of such a material cannot prevent leakage of the contents. And through many experiments which confirmed that fluoro resin or fluoro rubber is useful for the purpose of the present invention, he has accomplished the present invention.

Fluoro rubber, which is elastic, can be used as it is. Fluoro resin, which is hard and lacks elasticity, however, may be improved in sealability and slidability, when grooves 2',2' . . . are provided on the side surface of a movable plug 2 which is formed like a cylinder as shown in FIG. 1. There is no particular limit to the number of grooves 2', but at least one groove must be provided. Application of silicone to the internal surface of the cylinder 1 will also promote the slidability of the movable plug 2.

As fluoro resin, Teflon (trade name) is suitable; and as fluoro rubber Viton (trade name) is suitable.

In a test to verify the sealability of the movable plug in the present invention, a glass cylinder with one end perfectly sealed was filled with trialkyl boron and plugged with fluoro rubber (Viton) and this cylinder was left to stand, but no change in its contents or in its weight happened. By contrast, when it was plugged with polyethylene, the contents changed in several days.

It is desirable that the cylinder 1 is made of glass, because it permits the hardening agent 5 which fills it to be seen from the outside. It is, however, convenient for manufacturing reasons to fabricate the front plug 4 and the fine tube 8 of metal. These are fitted together by means of epoxy resin and the like.

Figure 2A:
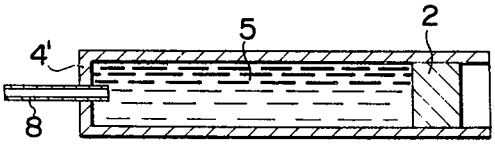
FIGS. 2 (*a*) and (*b*) are sectional views of two other embodiments of a dripping vessel according to the present invention.
Figure 2B:
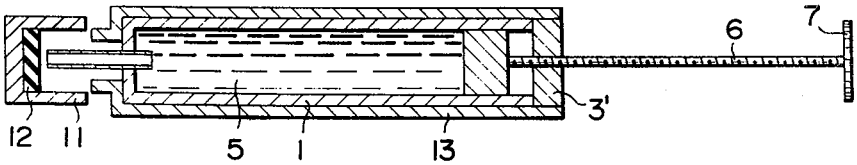

FIG. 1 illustrates a case in which the screw 6 forms part of an assembly including the cylinder 1, but to make it disposable, the vessel according to the present invention made as described below. FIG. 2*a* shows a vessel according to the present invention, wherein one end 4' of the cylinder 1 is closed with a fine tube 8 projecting through said one end; near the other end of it is provided a movable plug 2 and between these two ends the hardening agent 5 is contained. The user inserts said vessel into an outer casing 13 as illustrated in FIG. 2*b* and pushes forward the movable plug 2 by means of a screw 6 passing through a threaded bore in the end of the outer casing 13. Thereby, the vessel may be supplied in a sealed state with the tip of the fine tube 8 stuck into fluoro rubber or brazed, to be unsealed for use; or other modes of supplying may be available.

As illustrated in FIG. 1, the tip of the outer casing 13 is provided with a cap 11 to match.

As trialkyl boron does not corrode metals or glasses, metals such as iron, stainless steel and brass or special plastics besides glasses can be used for the cylinder. Besides trialkyl boron as a hardening agent, tri-n-butyl boron, tri-n-propyl boron, etc. are, for example, mentioned. They are unstable to oxygen or water in the air, but they can be surely maintained and used in the vessel of the present invention. The fine tube 8 installed on the tip portion of the vessel should be as fine as possible so as not to be subject to the influence of the air. Specifically, the tube may be 1 mm or less in diameter.

The grooves 2' provided in the moving plug 2 vary due to the nature of the hardening agent so that the numbers, width and depth thereof can be determined to suit.

As silicone to be coated on the grooves, γ-methacryloxy propyl, trimethoxy silane, etc. can be used. However, the present invention is not limited to them.

Trialkyl boron as a hardening agent can be used when containing other additives, for example, benzoyl peroxide, dimethyl para toluidine, etc. therein. These hardening agents are used to harden methyl metacrylate, acryl resin, etc.

The above description concerns a case of the filler being alkyl boron base hardening agent, but it goes without saying that the present invention is applicable to any liquid unstable to oxygen and water in the air.

What is claimed is:

1. A vessel for holding and dispensing a liquid alkyl boron compound, said vessel comprising:

a cylinder made of a material selected from the group consisting of metal and glass, said cylinder having a first end pierced by a fine tube, a movable plug within said cylinder, said plug being made of a material selected from the group consisting of fluoro rubbers and fluoro resins, means for moving said plug in said cylinder and operable from a point outside said tube, a removable cap for closing the outer end of said tube, said cap comprising a pad made of a material selected from the group consisting of fluoro rubbers and fluoro resins, and interengaging means on said cap and said cylinder for holding said pad in air-tight sealing engagement with said outer end of said tube.

2. A vessel as claimed in claim 1 in which said plug is provided with a plurality of circumferential grooves in the surfaces engaging said cylinder.

3. A vessel as claimed in claim 1 comprising a closure for the ther end of said cylinder provided with a threaded bore therein, and in which said plug-moving means is a rod extending through said bore and attached to said movable plug, said rod having threads mating with those of said bore.

4. A vessel as claimed in claim 1 comprising an outer jacket receiving said cylinder, a closure for the end of said outer jacket remote from said tube, said closure having a threaded bore therein, and in which said plug-moving means is a rod extending through said bore and attached to said movable plug.

5. A vessel as claimed in claim 1 in which said tube is at most 1 mm in diameter.

* * * * *